US007134661B2

(12) United States Patent
Trecartin

(10) Patent No.: US 7,134,661 B2
(45) Date of Patent: Nov. 14, 2006

(54) GAME WITH PLAY STRUCTURE AND PROJECTILE

(76) Inventor: Richard Trecartin, 45 William Curtis Circle, Newmarket, Ontario (CA) L3Y 8LY ( * ) Notice: Subject to any disclaimer, the term of this patent is extended or adjusted under 35 U.S.C. 154(b) by 0 days.

(21) Appl. No.: 10/944,726

(22) Filed: Sep. 21, 2004

(65) Prior Publication Data

US 2005/0077682 A1 Apr. 14, 2005

(51) Int. Cl.
*A63B 63/00* (2006.01)
*A63B 67/00* (2006.01)

(52) U.S. Cl. ..... 273/343

(58) Field of Classification Search ..... 273/348, 273/331, 343, 336

See application file for complete search history.

(56) References Cited

U.S. PATENT DOCUMENTS 1,075,865 A * 10/1913 Sharp ..... 273/343
2,797,924 A * 7/1957 Stewart ..... 273/343
3,685,826 A * 8/1972 Lehman ..... 273/343
3,731,931 A * 5/1973 Monaco ..... 273/343
3,774,911 A * 11/1973 Benfield ..... 273/343
3,792,864 A * 2/1974 Kelly ..... 273/393
5,165,694 A * 11/1992 Kraushaar ..... 273/343
6,308,956 B1 * 10/2001 Reid ..... 273/343
6,773,014 B1 * 8/2004 Lynch ..... 273/343
6,773,015 B1 * 8/2004 Long et al. ..... 273/343
6,808,175 B1 * 10/2004 Gleeson ..... 273/343
6,889,982 B1 * 5/2005 Gove ..... 273/343
2002/0084588 A1 * 7/2002 Lynch ..... 273/343
2005/0017455 A1 * 1/2005 Long et al. ..... 273/343
2005/0077682 A1 * 4/2005 Trecartin ..... 273/343
2005/0082761 A1 * 4/2005 Lynch ..... 273/343
2005/0269784 A1 * 12/2005 Peters ..... 273/343

* cited by examiner

*Primary Examiner*—Raleigh W. Chiu
(74) *Attorney, Agent, or Firm*—Eugene J. A. Gierczak

(57) ABSTRACT

A gaming apparatus, gaming kit and gaming method is provided, which involves throwing projectiles to hang off of, or wrap around, one or more support members of a target structure. A projectile is also provided, which includes two weights at either end of a rope member. The rules of play define points that awarded for throwing one or more projectiles to hang off of, or wrap around, one or more particular support members, or particular portions of such one or more particular support members. A self-supporting target structure is provided, as well as a target structure that can be mounted on a wall.

15 Claims, 15 Drawing Sheets

GAME WITH PLAY STRUCTURE AND PROJECTILE

FIELD OF THE INVENTION

This invention relates in general to games using projectiles to hit predetermined targets. This invention relates more particularly to games using projectiles to hit predetermined targets for use outdoors.

BACKGROUND OF THE INVENTION

Prior games using projectiles to hit predetermined targets are known. The game of darts is an example. Various forms of croquet are also known which involve the erection of play structures including poles and gates in the grass. In the case of croquet, a mallet is used to project a ball along the course.

There is a need for a new game that is easy to play for members of different age groups, and easy and inexpensive to manufacture.

SUMMARY OF THE INVENTION

A gaming apparatus is provided. One aspect of the invention is a gaming apparatus including at least one target structure that includes a structure that a projectile hangs from or wraps around. Another aspect of the invention is the projectile that includes at least two weights and a connecting member between the at least two weights.

Further aspects of the invention include various embodiments of the structure of the at least one structure, and also the projectile. The target structure generally consists of a plurality of frame members and at least one support member or bar disposed between the frame members.

A still other aspect of the present invention is a method of playing a game using the gaming apparatus of the invention.

It is one object of the present invention to provide a game involving throwing a projectile to hang off of or wrap around a target structure. It is a further object of the present invention to provide such a game that is easy to play and inexpensive to manufacture.

BRIEF DESCRIPTION OF THE DRAWINGS

A detailed description of the preferred embodiment(s) is (are) provided herein below by way of example only and with reference to the following drawings, in which.

Figure 1:
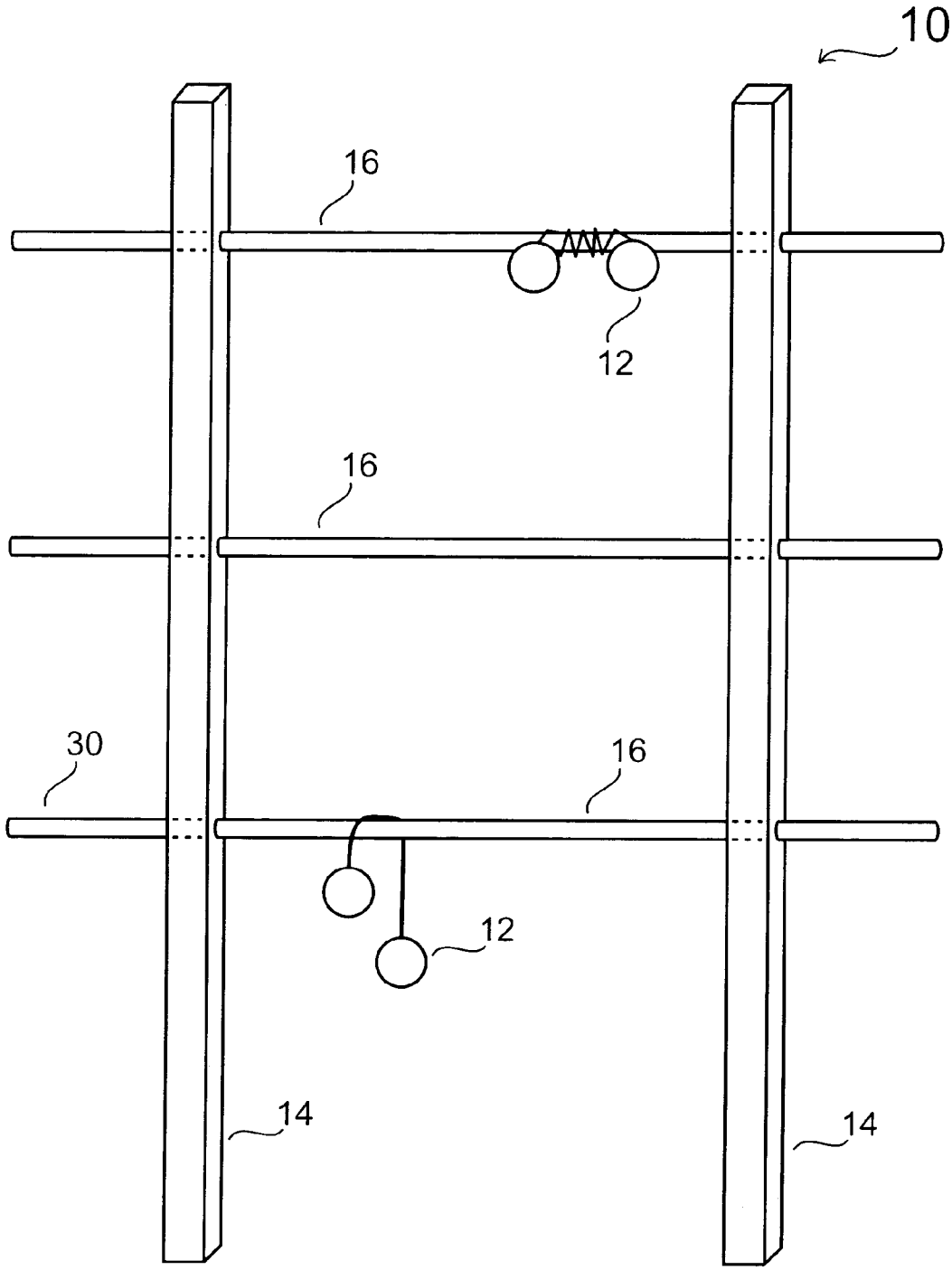
FIG. 1 is a perspective view of an embodiment of the target structure of the present invention, in an erected position, with two projectiles of the present invention, looped around bars of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

One aspect of the present invention is a gaming apparatus. As best illustrated in FIG. 1, the game of the present invention includes a target structure 10 and at least one projectile 12 of the present invention. The target structure 10 includes generally at least two frame members 14 of generally vertical structure, and at least one support member or bar 16 (which are generally horizontal) disposed between the at least two frame members 14.

The purpose of the game of the present invention is generally to manually project the projectiles 12 such that they hang off the bar or bars 16. The rules of game are further particularized below.

The game of the present invention is generally for outdoor use, however, can be used indoor as well.

Figure 2:
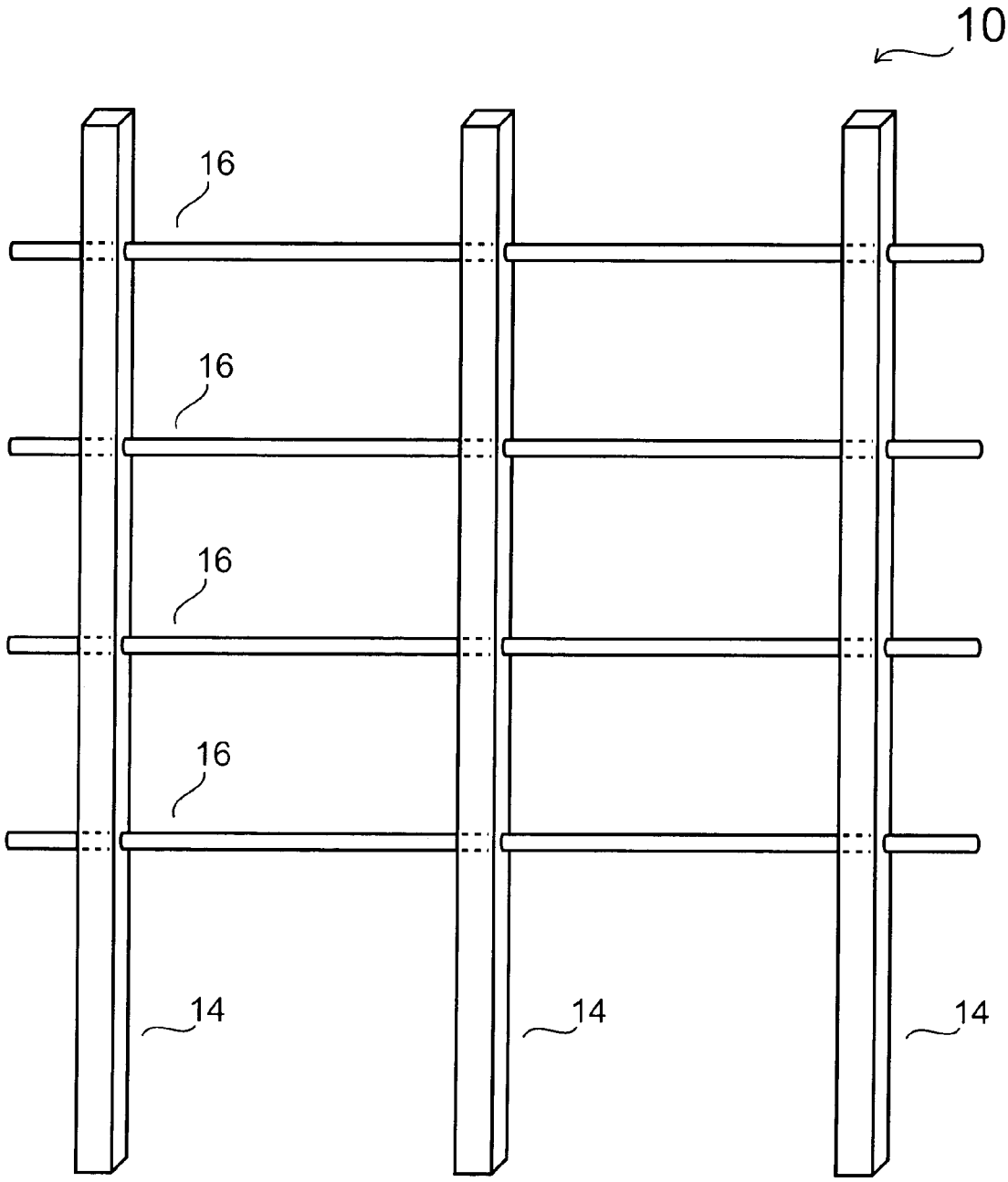
FIG. 2 is a perspective view of an alternate embodiment of the target structure of the present invention, in an erected position.

FIG. 2 illustrates an alternate embodiment of the target structure of the present invention in which there are three frame members 14. A greater number of frame members 14 are also possible. In this particular embodiment of the present invention, there are four series of substantially parallel bars 16 or bar assemblies 16. A greater number of bars or bar assemblies 16 are also possible.

Figure 3:
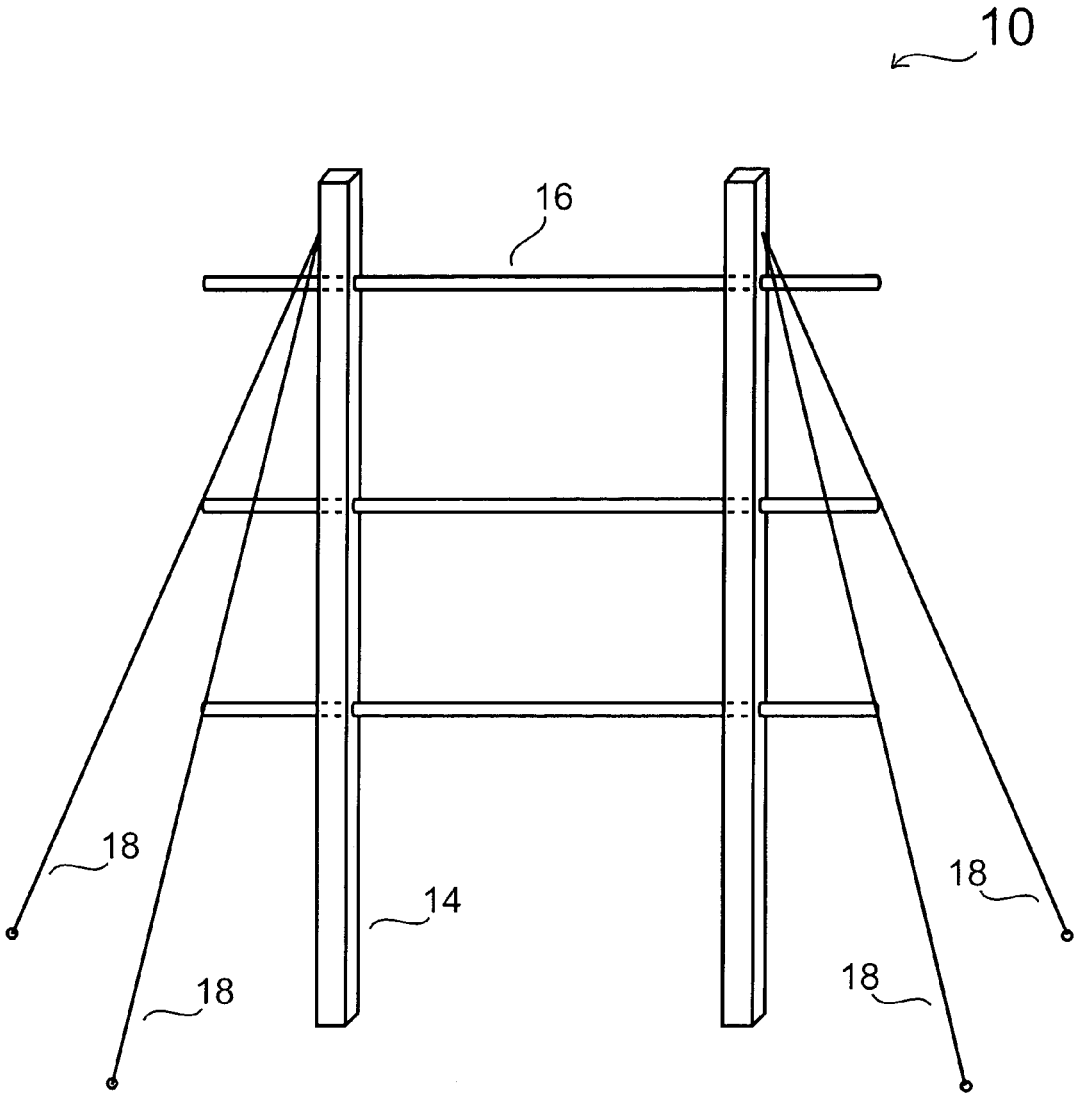
FIG. 3 is a perspective view of a third representative embodiment of the target structure of the present invention, including a plurality of stabilizers.
Figure 4:
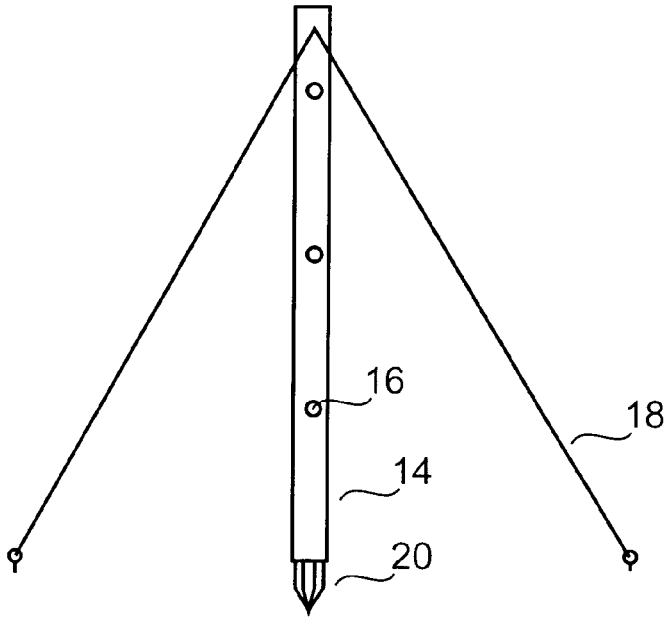
FIG. 4 is a side view of the embodiment of the target structure shown in FIG. 3.
Figure 5:
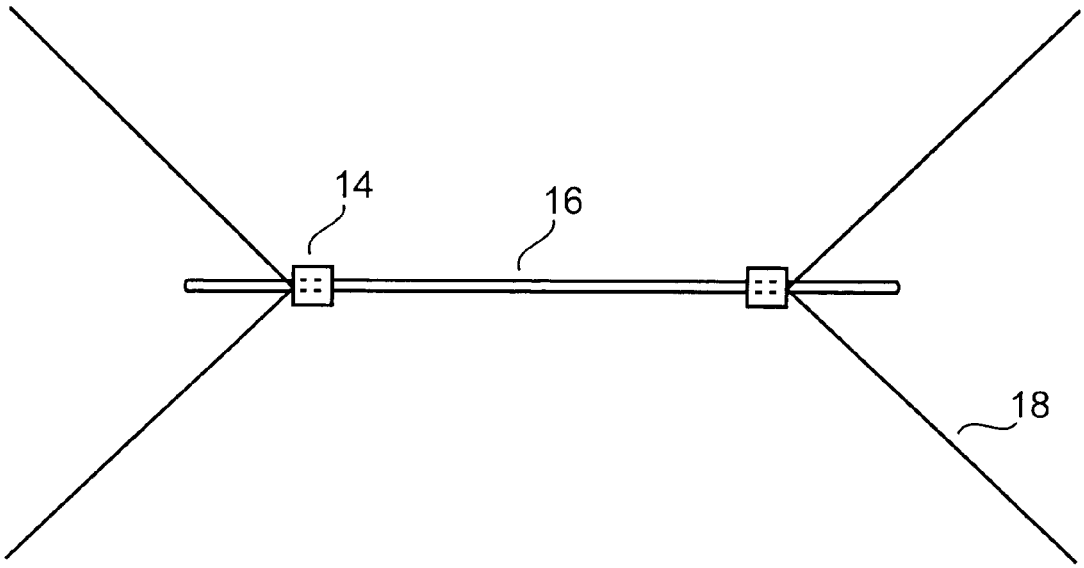
FIG. 5 is a top view of the embodiment of the target structure shown in FIG. 3.

The target structure 10 is maintained in an upright position, in accordance with the invention. The use of the one or more projectiles 12, as explained below, makes it preferable that the target structure 10 be able to maintain its upright position in play. FIG. 3 illustrates one aspect of maintenance of the target structure this upright position, namely the use of the stabilizers 18 shown in this Figure. These stabilizers are connected to the frame members 14 adjacent to the top end thereof, at one end of the stabilizers, and attached to the ground using a peg or the like at the other end thereof. The frame members 14 are forced into the ground by means of the means provided at the bottom end thereof to force the frame members 14 into the ground such as the wedge or tapered end 20 thereof illustrated in FIG. 4. FIG. 4 also shows the stabilizers 18. FIG. 5 illustrates the use of the stabilizers 18 in a top view of the embodiment of the target structure shown in FIG. 3.

Figure 6:
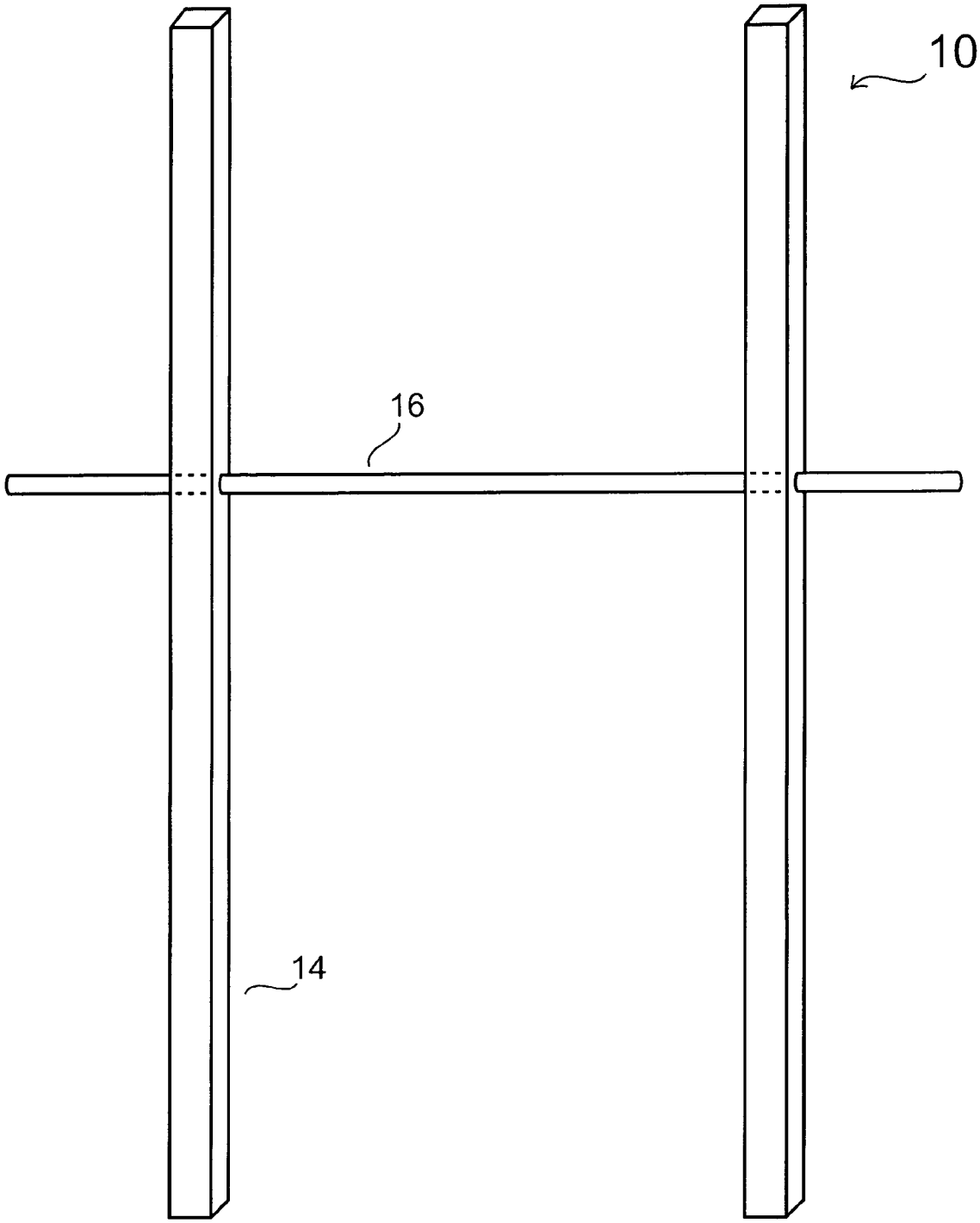
FIG. 6 is a perspective view of a fourth representative embodiment of the target structure of the present invention.

FIG. 6 illustrates in a perspective view an alternate embodiment of the present invention in which the target structure 10 includes one bar 16 only.

Figure 7:
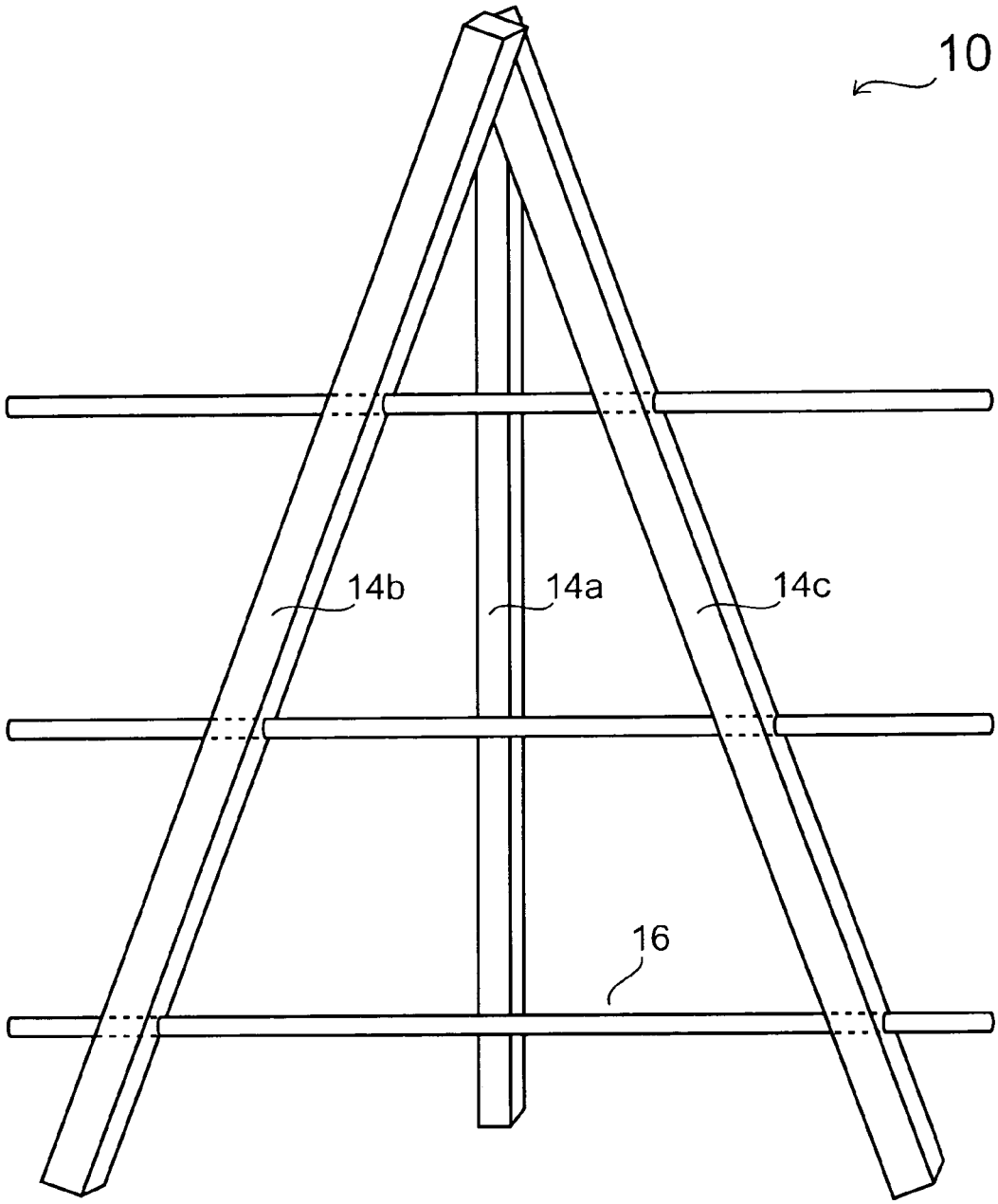
FIG. 7 is a perspective view of a fifth representative embodiment of the target structure of the present invention.

FIG. 7 is a perspective view of another embodiment of the target structure 10 of the present invention in which there is a central substantially vertical frame member 14*a*, and two angled frame members 14*b* and 14*c* in triangular configuration.

Figure 8:
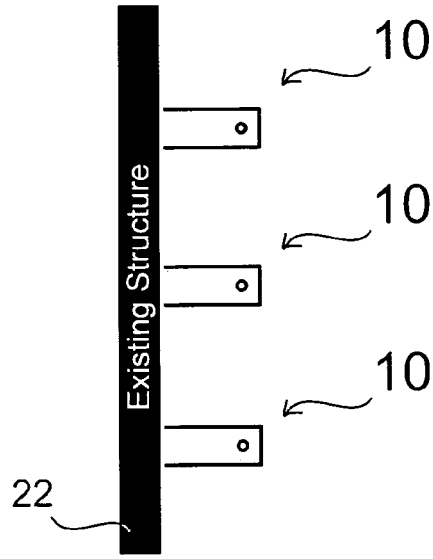
FIG. 8 is a side view of a sixth representative embodiment of the target structure of the present invention, for mounting on a vertical structure such as a wall.
Figure 9:
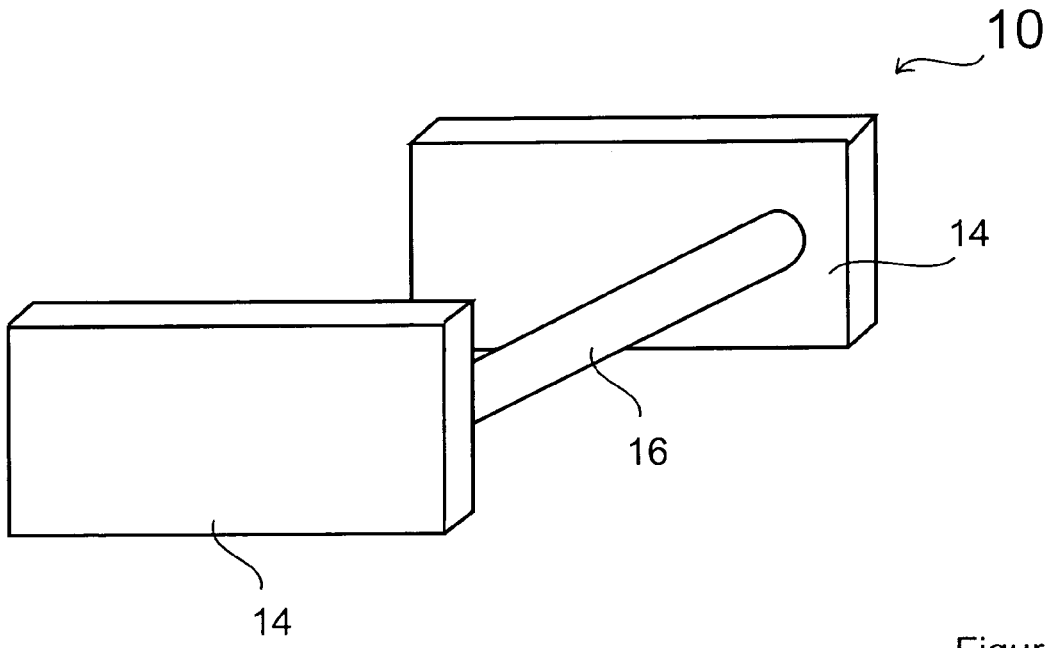
FIG. 9 is a side perspective view of the embodiment of the target structure shown in FIG. 8.

FIGS. 8 and 9 illustrate an alternate embodiment of the target structure 10 of the present invention wherein the frame members 14 consist of at least two members that are adapted to be mounted on an existing structure such as a wall 22, as shown in FIG. 8. The frame members 14 of this embodiment define a predetermined space between the wall 22 and the bar 16, determined by references to the projectile 12, such that wall 22 does not interfere with play. As illustrated in FIG. 8, this particular embodiment of the present invention will generally involve the mounting of a series of target structures 10 in sequence.

Figure 10:
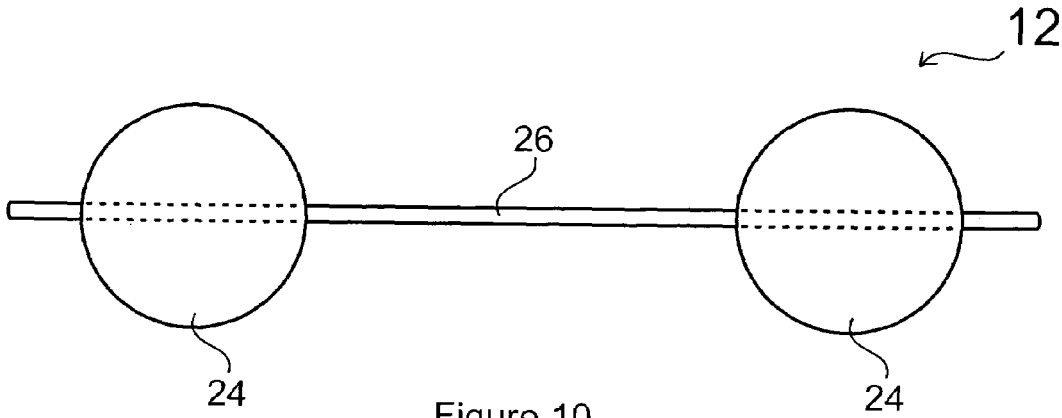
FIG. 10 illustrates an embodiment of the projectile of the present invention.
Figure 12:
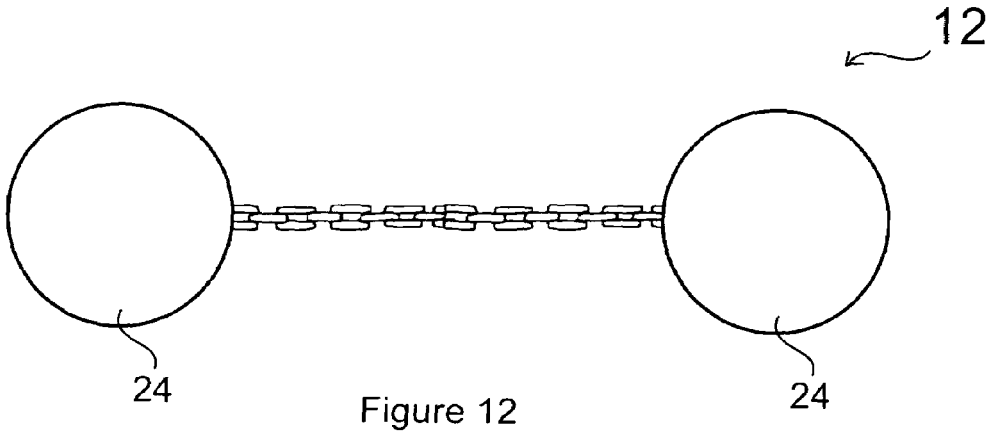
FIG. 12 illustrates an embodiment of the projectile of the present invention in which the weights are connected by a chain.

FIG. 10 illustrates an embodiment of the projectile 12 of the present invention. The projectile 12 generally consists of a pair of weights 24 interconnected by a flexible member 26 that is adapted to wrap around the bar 16, such as a piece of cable or string, or as shown in FIG. 12, a piece of chain. The weights 24 enable the projectile 12 to be projected through the air and onto the target structure 10.

The weights 24 can be disposed of different types of material, provided the weights 24 suitable for enabling the projectile 12 to be thrown through the air. Weight 24 type constructions were found to be suitable, however, in some applications it may be desirable to use a soft exterior for safety reasons. Otherwise, use of items such as a golf ball as the weights 24 was found to provide the desired functionality.

Figure 13:
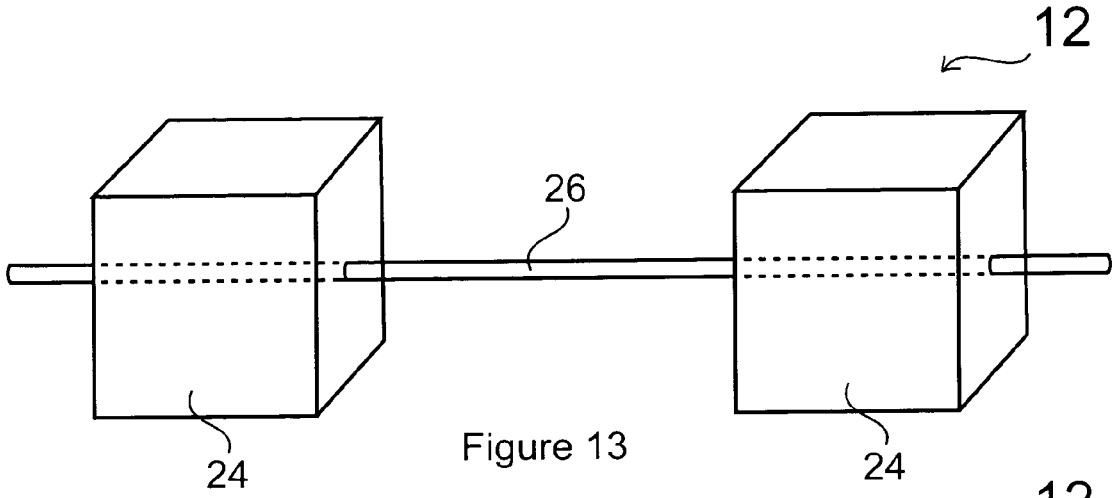
FIG. 13 illustrates an alternate embodiment of the projectile of the present invention in which the weights are cube-shaped.
Figure 14:
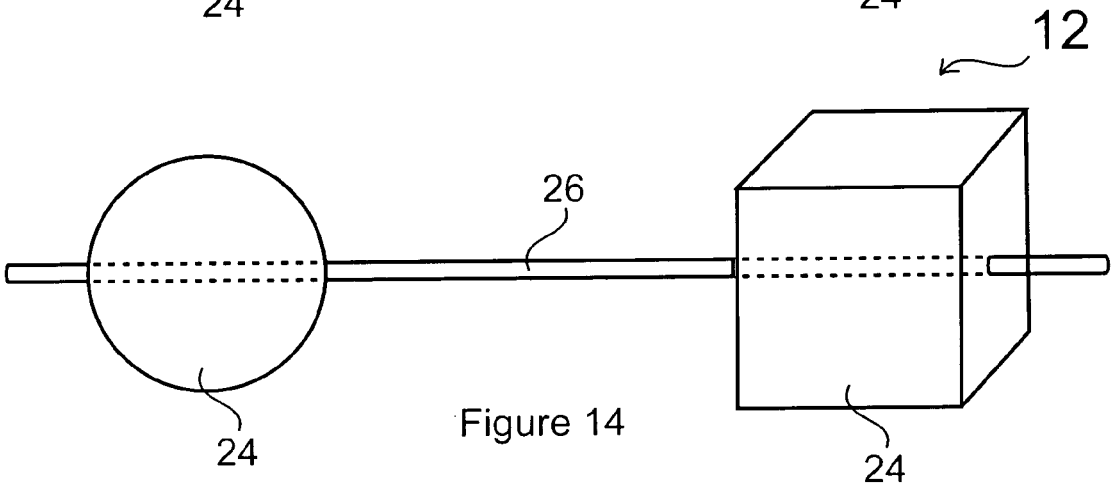
FIG. 14 illustrates another alternate embodiment of the projectile of the present invention in which the weights are of different shapes.

The weights 24 can have various shapes, for example, cubic as shown in FIG. 13. The weights 24 need not be of the same shape, as shown in FIG. 14. It should also be understood that the weights 24 could be provided in any ornamental or character design, such as for promotional reasons in the shape of action figures or other distinctive shapes.

In the preferred embodiment of the projectile 12, the weights 24 are of relatively similar size and relatively similar weight. However, as shown in FIG. 11, an alternate embodiment can be used where the weights 24 are of different size, different weight, different shape or different material.

Figure 11:
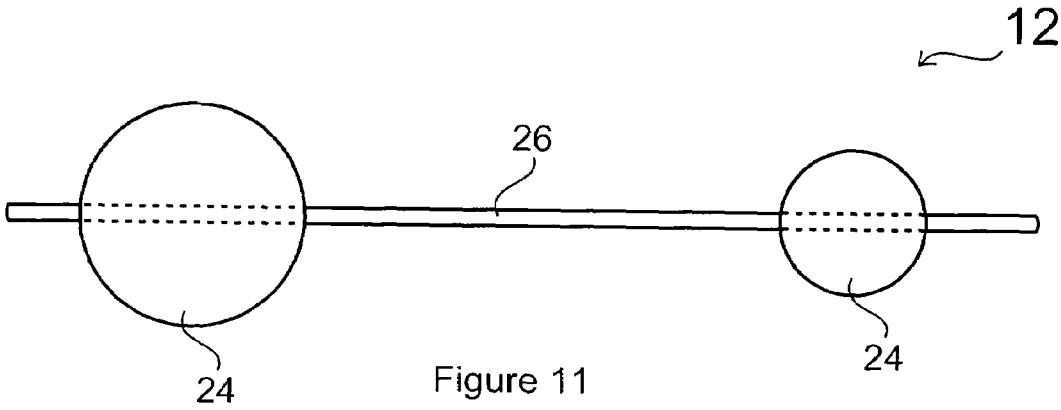
FIG. 11 illustrates an alternate embodiment of the projectile of the present invention in which the weights are of different sizes.
Figure 16:
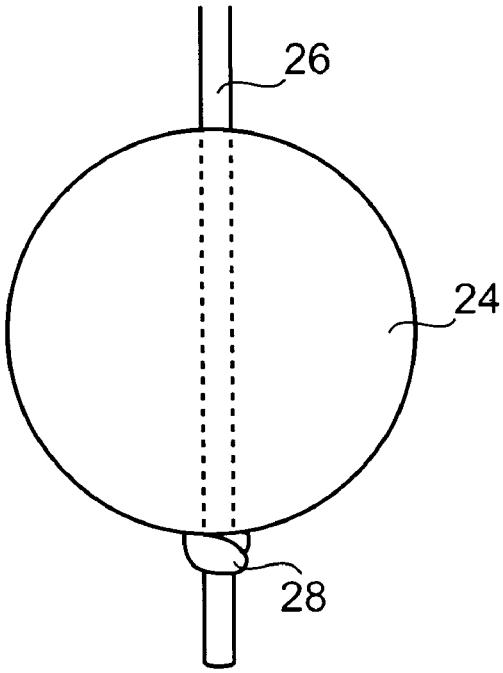
FIG. 16 illustrates an embodiment of the projectile of the present invention wherein a hole is bored through the weight to receive the string or cable.

As particularly shown in FIGS. 10 and 11, the projectile 12 is provided by a leading the flexible member 26 through a bore disposed through the weights 24. As shown in FIG. 16, some means is provided at the outside end 28 of the weight to maintain the flexible member 26 in place, such as a knot or blocking member.

Figure 15:
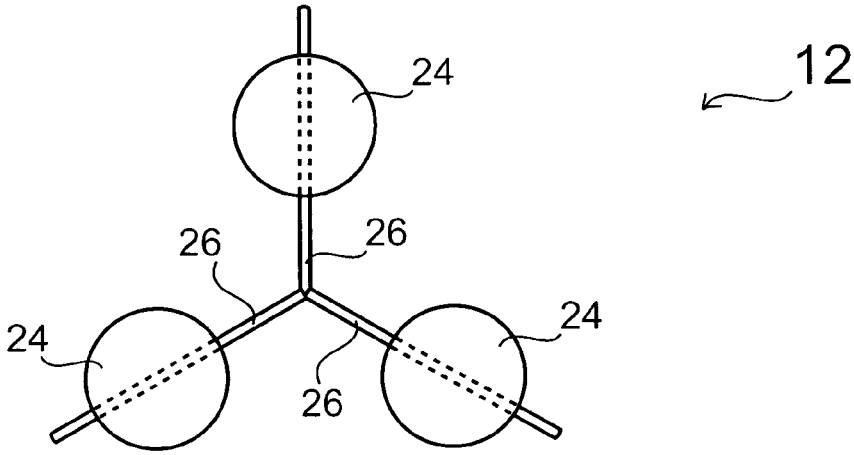
FIG. 15 illustrates an alternate embodiment of the projectile of the present invention where there are three interconnected weights.

FIG. 15 illustrates that a series of more than two interconnected weights 24 can be used, although the preferred embodiment of the projectile 12 of the invention includes two weights 24.

Figure 17:
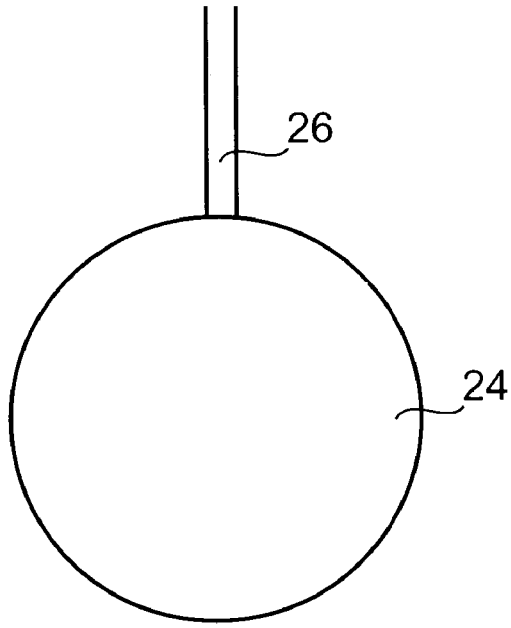
FIG. 17 illustrates another embodiment of the projectile of the present invention wherein the string is adhered to one end of the weight.

As shown in FIG. 17, the flexible member 26 can also be attached to the weights 24 using a suitable attachment means such as an adhesive, or a screw for example, without the need for a bore through the weight 24.

Figure 18:
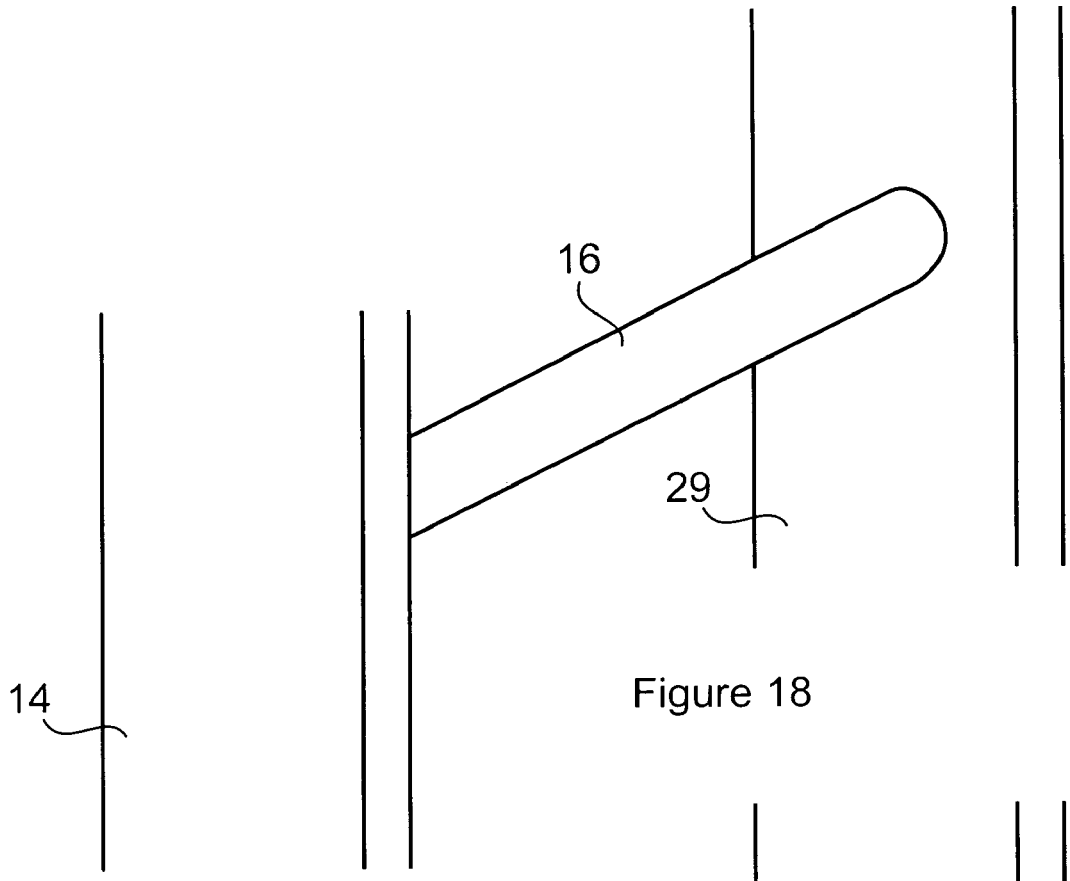
FIG. 18 is a partial perspective view of the target structure of the present invention, illustrating the interconnection of the frame members and one support member.
Figure 19:
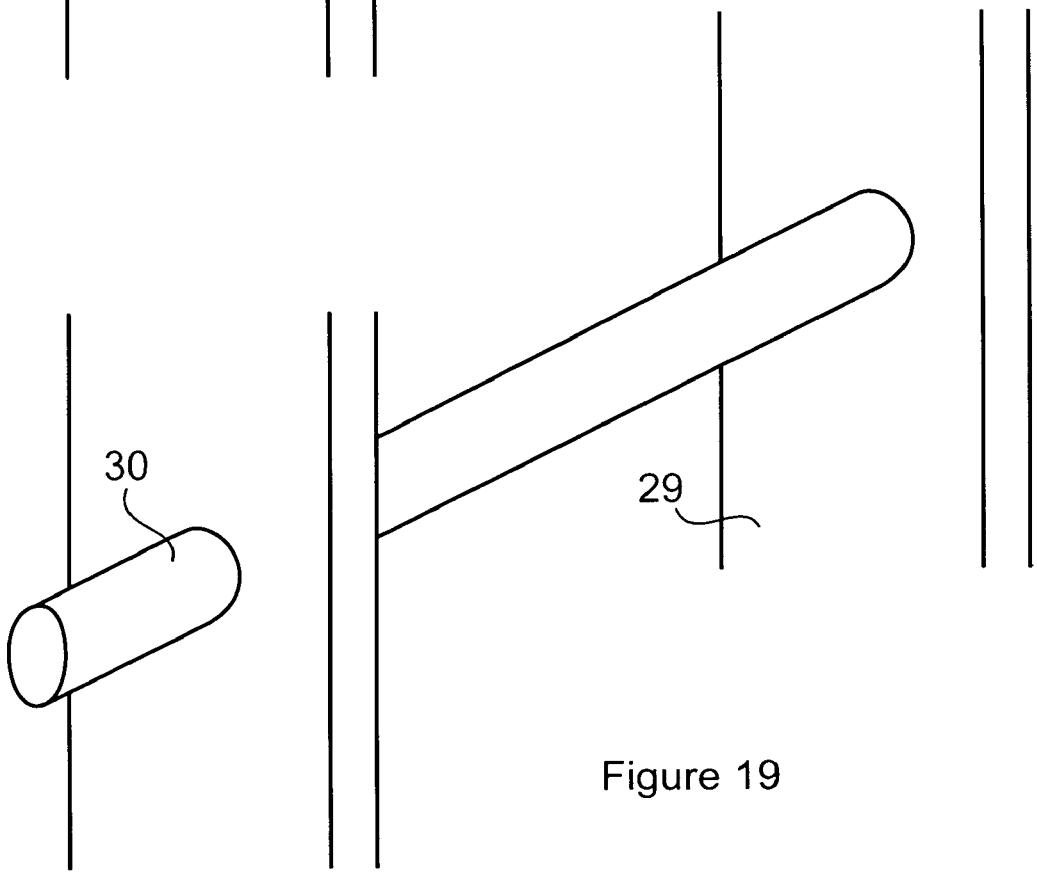
FIG. 19 is a partial perspective view of the target structure of the present invention, illustrating an alternate interconnection of the frame members and one support member.
Figure 20:
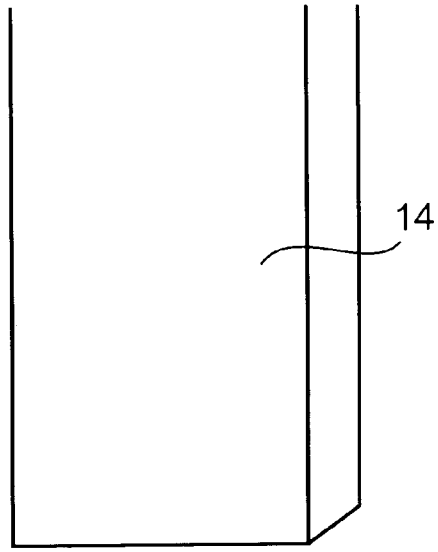
FIGS. 20–22 illustrates different embodiments of the bottom end of the frame members.

FIGS. 18 and 19 illustrate two different embodiments of the interconnection of the frame members 14 and one support member or bar 16. FIG. 18 shows an embodiment of the invention whereby the bar 16 is connected to the frame members 14 by means of an adhesive, or friction fitting the bar in a corresponding aperture on the interior wall 29 of the frame member 14, in a manner that is known.

Also as shown in FIG. 19, the present invention contemplates the bar 16 protruding through a bore disposed in the frame member 14. The protruding portion 30 can have significance during play, as explained below.

Figure 21:
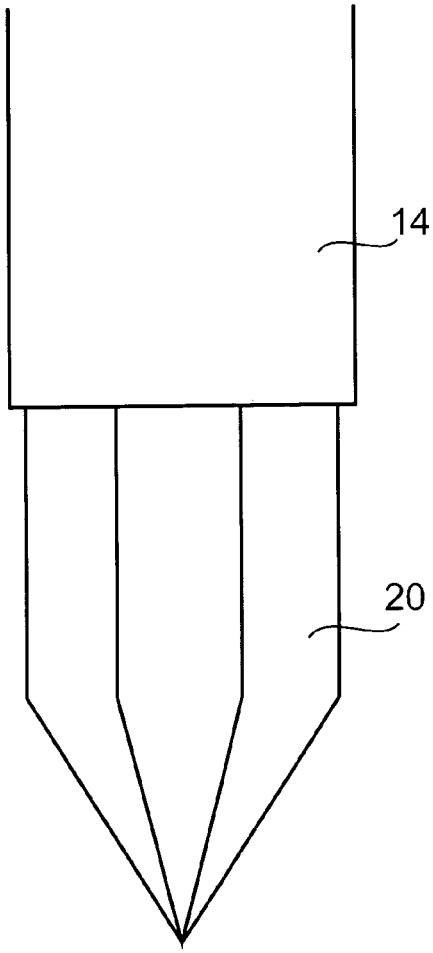
Figure 22:
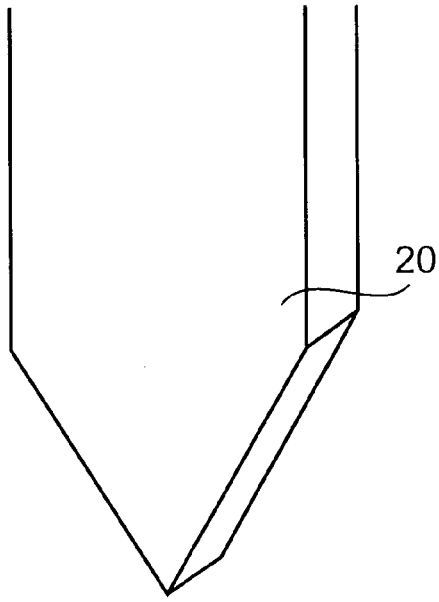

The gaming apparatus of the present invention is generally played outdoors. It is convenient in use for the target structure 10 of the present invention to be supportable in an upright position. FIGS. 21–22 illustrate different embodiments of the bottom end of the frame members 14 that enable the target structure 10 to be driven into the ground to provide support, by means of a wedge 20.

Figure 23:
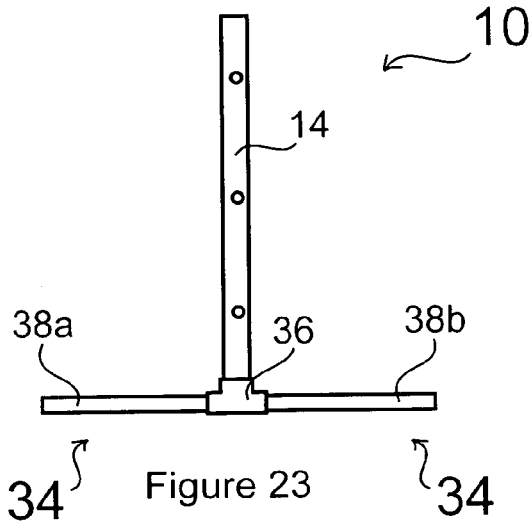
FIGS. 23 and 24 represent in a side view an alternate self-supporting embodiment of the target structure of the present invention.
Figure 24:
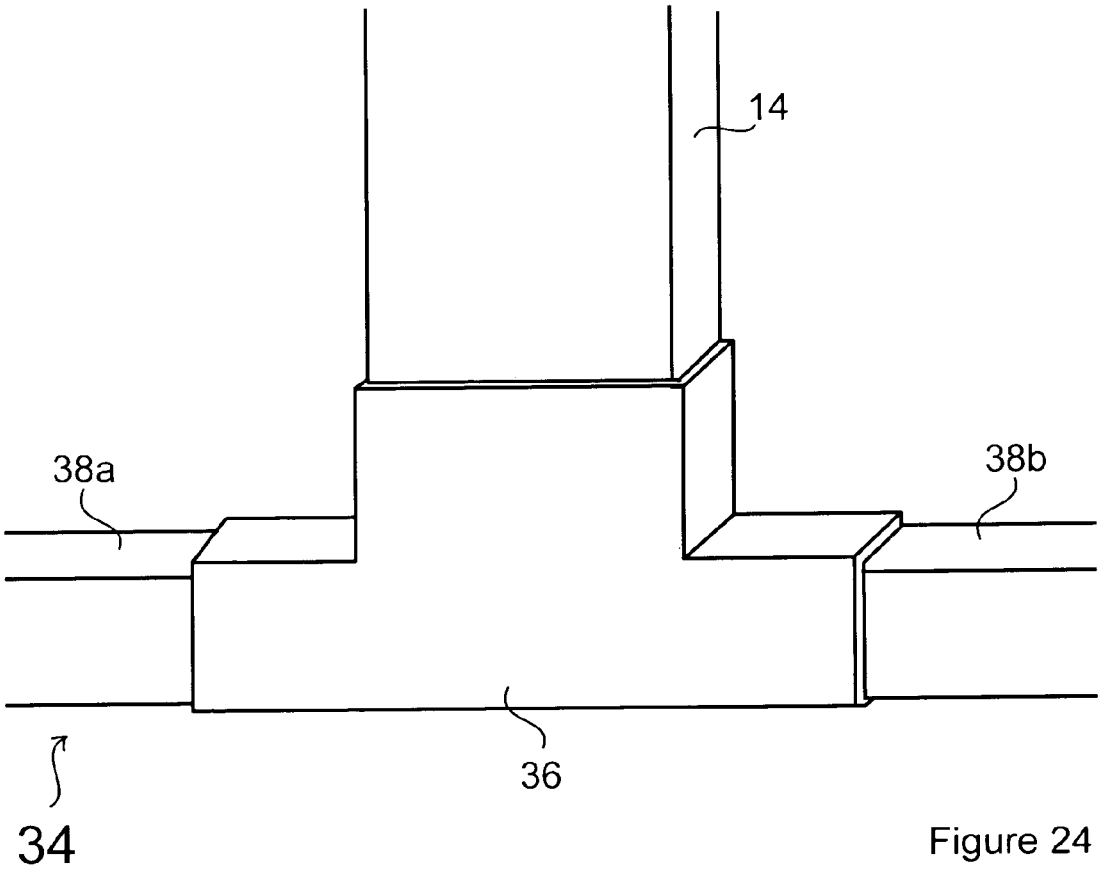
Figure 25:
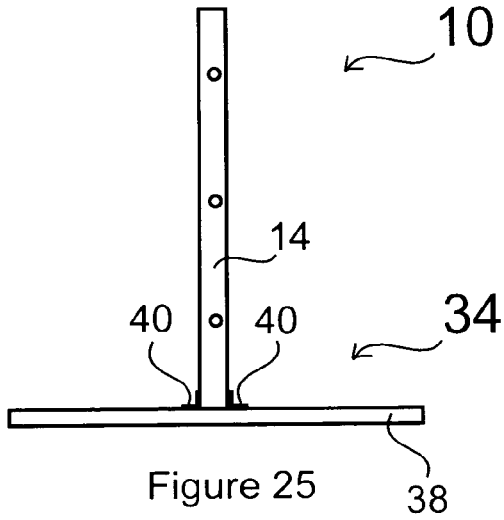
FIGS. 25 and 26 represent in a side view the self-supporting embodiment of the target structure illustrated with FIGS. 23–24, however, with a pair of support braces.
Figure 26:
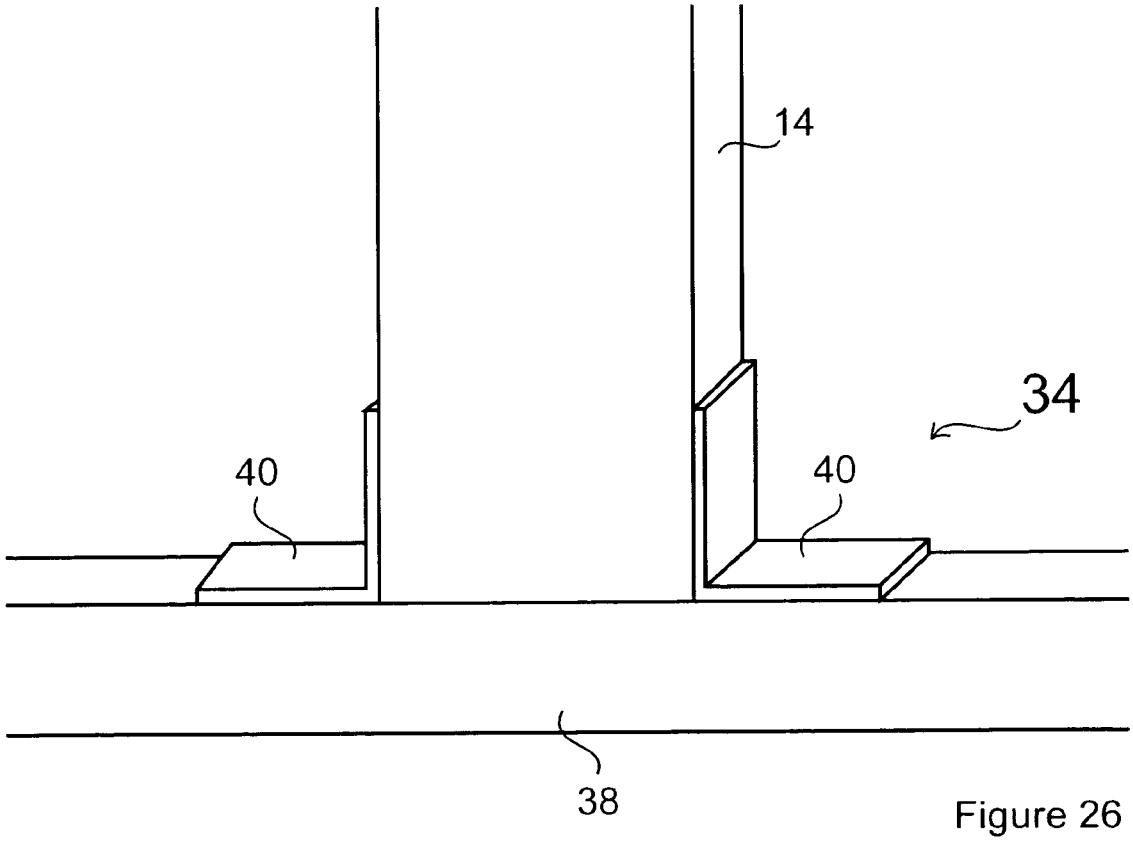
Figure 27:
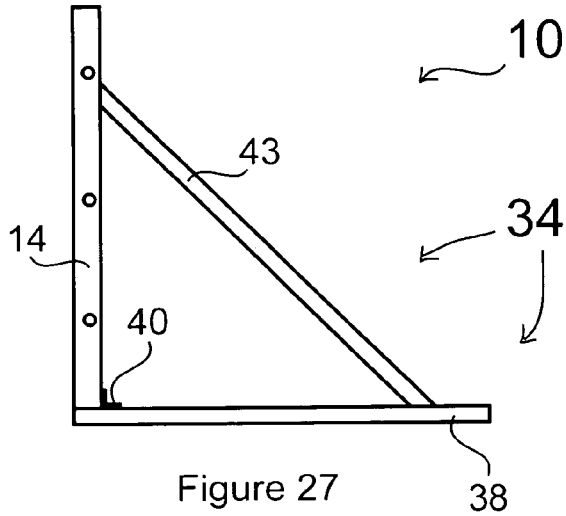
FIGS. 27 and 28 represent in a side view an alternate self-supporting embodiment of the target structure of the present invention, including a support brace and cross-support.
Figure 28:
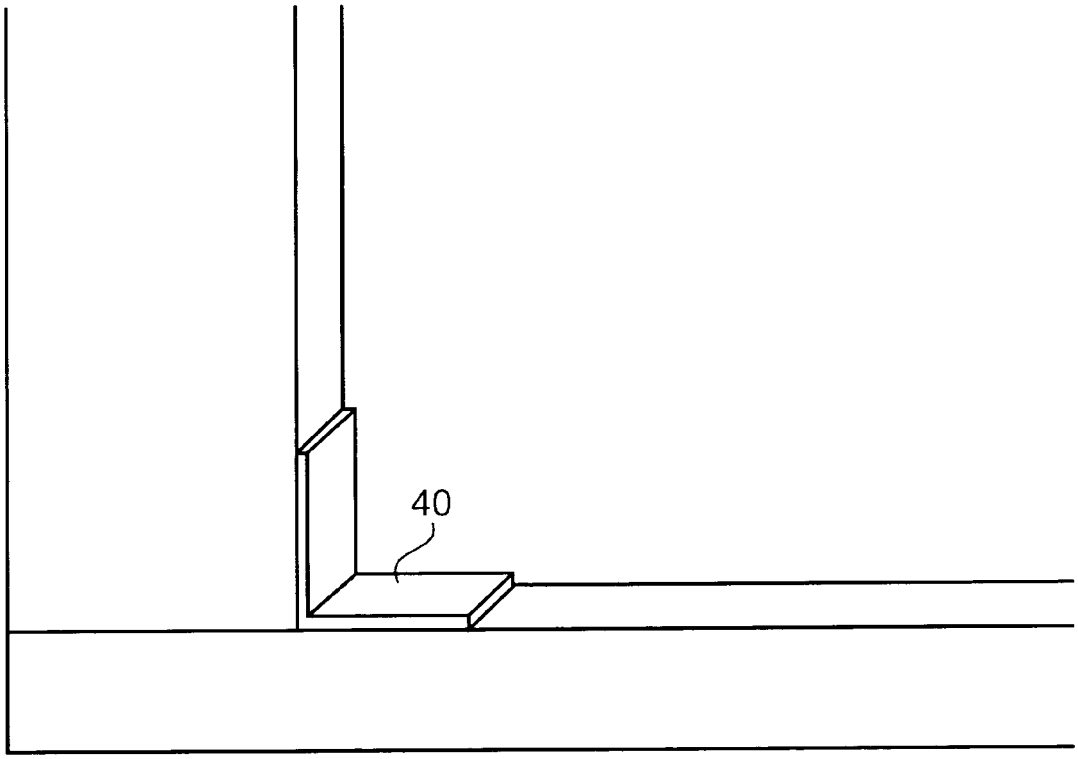

FIGS. 23–28 illustrate alternate embodiments of the target structure 10 wherein the frame members 14 are self-supporting. As shown in FIGS. 23 and 24, for example, the frame members 14 include a base 34. The base 34, in the specific embodiment shown in FIGS. 23 and 24 includes a joint 36 pair of base members 38*a* and 38*b*, wherein the joint 36 interconnects the frame members 14 and the base members 38*a* and 38*b*. Alternatively, as shown in FIGS. 25 and 26, base 34 may consist of a single base member 38 that is fixed to the frame member 14, for example, by means of a pair of support brackets 40. FIGS. 27 and 28 illustrate another self-supporting target structure 10 of the present invention wherein the base 34 consists of a single base member 38 disposed substantially toward one end of the frame member 14 and further includes a support arm 42 to add strength, and a single bracket 40.

The purpose of the particular structures of the target structure 10 illustrated herein is to provide sufficient structural integrity and stability to enable play as described below.

The gaming apparatus of the present invention enables play in accordance with the gaming method of the present invention.

In one embodiment of the gaming method of the present invention, the game is for play by multiple players. The purpose of the gaming method of the present invention is to win the highest score by throwing one or more projectiles 12 such that they hang off of, or become wrapped around, one or more bars 16.

One or more target structures 10 are set in an upright position in a play area. One target structure 10 can be used. In the preferred embodiment of the present invention, two target structures 10 are placed approximately thirty feet from one another. A start area is defined by the players from which they attempt to throw the projectiles 12 onto the bars 16.

In one particular embodiment of the gaming method, for singles:

A plurality of projectiles are used in each game, for example, six. Each player alternates throwing their projectile 12 such as Player 1, Player 2, Player 1, etc. until all the projectiles 12 have been thrown toward the target structure 10. It is permitted to knock off the opponent's projectile 12 from the bars 16. After all six projectiles 12 have been thrown, the points are tallied. Only projectiles 12 still hanging from the target structure 10 at the end of the round are counted. The players continue playing until a player accumulates 21.

In another particular embodiment of the gaming method, for team play, the same gaming method described above is followed except each player will challenge a player from the opposing team, as described above, until one of the teams reaches 21.

It is generally determined who will start the game by each player, or a representative player for each team, throwing a single projectile 12, wherein the team with the highest score on the single throw will start.

In accordance with one embodiment of the gaming method of the present invention, alternate score values are given to different bars 16. For example, in an embodiment of the target structure 10 having three bars 16, the lowest bar will be worth 1 point, the middle bar 2 points, and the top bar 3 points. These points may also vary.

It should be understood that alternate definitions of the score value of the projectile 12 remaining in position on a bar, or a particular bar area are contemplated. For example, extra points could be awarded for the projectile 12 wrapping around one of the projecting sections 30 of the bars 16 shown in FIG. 1. Similarly, particular bars 16 or bar segments shown in FIG. 2 can have different score values.

It is generally found that points are most easily scored by grasping the projectile 12 at one end and throwing it in an arc aligned with the target structure 10.

It should be understood that in accordance with the preferred gaming method, the players must reach exactly 21 points. If a team is in the lead with 19 points and scores 3 points (i.e. in excess of 21 points in total), the three points will be subtracted from their score for 16 points. This tends to hold the interest of a team that may be trailing relatively far behind.

Other variations are possible. The projectile 12 may be made of an extruded foam-like material for indoor use. The method of game can be altered without departing from the basic gaming method involving the projectile and target structure described. For example alternate scoring methods are possible, or the decrease or increase of the disclosed number of target structures used.

The invention claimed is:

1. A gaming system comprising:

(a) at least one projectile including an elongate, flexible member; and (b) a target structure: at least two frame members and at least one support bar or bar assembly connected to the frame members and disposed between the frame members, the frame members being operable to support the support bar or bar assembly in a generally upright horizontal position, the frame members and support bar or bar assembly defining:

(i) at least one middle section of the support bar or bar assembly disposed between the frame members; and (ii) an end section of the support bar or bar assembly extending beyond the frame members;

each support bar or bar assembly being disposed so as to enable the at least one projectile to be thrown from a starting point to the target structure so as to cause the at least one projectile to either hang from or wrap around the middle lie section(s) or end sections, thereby scoring points as determined based on a plurality of predetermined play rules.

2. The gaming system as claimed in claim 1, wherein the at least one projectile consists of:

(c) a rope member; and (d) a weight member disposed at either end of the rope member.

3. The gaming system as claimed in claim 1, wherein the target structure includes a plurality of support bars or bar assemblies, and wherein a game value is assigned to the middle sections and end sections of each support bar or bar assembly, the game value determining the number of points assigned during play to the at least one projectile either hanging from or wrapping around a particular one of the middle sections or end sections of the plurality of support bars or bar assemblies.

4. The gaining system as claimed in claim 1, wherein the target structure consists of a self-supporting structure, the self-supporting structure including: two frame members and three support bars or bar assemblies being connected to the two frame members, the frame members thereby supporting the three support bars or bar assemblies in a generally upright horizontal position.

5. The gaming system as claimed in claim 4, wherein the at least two frame members include at one end thereof a wedge, such that the at least two frame members are operable to be driven into the ground by directing manual force to the at least two frame members.

6. The gaming system as claimed in claim 5, wherein the target structure further includes a stabilizing means connected to one or more of the at least two frame member, the stabilizing means being operable to stabilize the target: structure to maintain same in a generally upright position.

7. The gaming system as claimed in claim 1, including; three frame members connected to the at least one support bar or bar assembly to define a tripod like structure.

8. The gaining system as claimed in claim 1, wherein the target structure consists of at least one support bar or bar assembly connected to a wall assembly, the wall assembly consisting of a frame member that is operable to be mounted on a wall.

9. The gaming system as claimed in claim 1, wherein the target structure includes a self-supporting structure, the self-supporting structure including one or more frame members, one or more of such frame members including:

(a) a substantially vertical upper portion for connection to the at least one support bar or bar assembly; and (b) a substantially horizontal lower portion connected to the upper portion, the lower portion being operable to support the upper portion in a substantially vertical position.

10. A multi-player gaming method using a target structure, the target structure including at least two frame members and at least one support bar or bar assembly connected to the frame members and disposed between the frame members, the frame members being operable to support the support bar or bar assembly in a generally upright horizontal position, the frame members and the support bar or bar assembly defining at least one middle section of the support bar or bar assembly disposed between the frame members; and an end section of the support bar or bar assembly extending beyond the frame members; the support bar or bar assembly being disposed so as to enable the at least one projectile to be thrown from a starting point to the target structure so as to cause the at least one projectile to either hang from or wrap around the middle section(s) or the end sections of the support bar or bar assembly, thereby scoring points as determined based on a plurality of predetermined play rules, the method comprising the steps of:

(a) each player, in sequence, throwing from a predetermined area defining a distance between each player and to target structure, one or more projectiles to attempt to place the one or more projectiles on the target structure such that the projectile hangs off of and/or wraps around the at least one support bar or bar assembly; and (b) determining the score of each player by calculating the sum of values achieved by each player depending on the middle section(s) or end section(s) on which the player placed the one or more projectiles on the target structure, based on a location of each of the one or more projectiles so placed on the target structure and a predetermined game value for each such location, the sum of such predetermined game values of: such one or more placed projectiles defining the score for each player.

11. The method claimed in claim 10, comprising the further step of determining by chance the order in which the plurality of players will throw the one or more projectiles.

12. The method claimed in claim 11, comprising the further step of each player throwing an equal number of projectiles during a round by taking turns in the order determined by throwing the one or more projectiles.

13. The method claimed in claim 12, whereby the scores of each of the plurality of players are tallied at the end of the round based on the number of projectiles of each of the plurality of players that are still hanging off of and/or wrapped around the at least one support bar or bar assembly.

14. The method claimed in claim 13, comprising the further step of throwing one or more projectiles to remove one or more of the projectiles of an opposing player.

15. The method claimed in claim 14, whereby one player challenges a second player until one of such players reaches a predetermined score.

* * * * *